US009035208B2

(12) United States Patent
Warner et al.

(10) Patent No.: US 9,035,208 B2
(45) Date of Patent: May 19, 2015

(54) CONTROL MODULE WITH REDUNDANT SWITCHES

(71) Applicants: Brian M. Warner, Oxford, NY (US); Gregory W. Smiley, Greene, NY (US)

(72) Inventors: Brian M. Warner, Oxford, NY (US); Gregory W. Smiley, Greene, NY (US)

(73) Assignee: The Raymond Corporation, Greene, NY (US)

( * ) Notice: Subject to any disclaimer, the term of this patent is extended or adjusted under 35 U.S.C. 154(b) by 133 days.

(21) Appl. No.: 13/728,218

(22) Filed: Dec. 27, 2012

(65) Prior Publication Data

US 2014/0183017 A1 Jul. 3, 2014

(51) Int. Cl.

| | |
|---|---|
| ***H01H 23/00*** | (2006.01) |
| ***H01H 9/00*** | (2006.01) |
| ***H01H 11/00*** | (2006.01) |

(52) U.S. Cl.

CPC ..... *H01H 9/0066* (2013.01); *H01H 11/00* (2013.01)

(58) Field of Classification Search

CPC ... H01H 9/0066; H01H 11/00; H01H 13/702; H01H 11/0056; H01H 13/48; H01H 2219/062; H01H 2221/016; H01H 2231/026; H01H 2300/014; H01H 2300/038; H01H 23/30; H01H 25/008; H01H 25/041; H01H 9/0214; H01H 9/04; H01H 2215/012; H01H 2223/002; H01H 2223/032; H01H 2229/02

USPC ..... 200/5 A; 29/622

See application file for complete search history.

(56) References Cited

U.S. PATENT DOCUMENTS

| | | | |
|---|---|---|---|
| 4,287,966 | A | 9/1981 | Frees |
| 4,347,416 | A | 8/1982 | Ogden |
| 5,430,266 | A | 7/1995 | Austin |
| D384,478 | S | 9/1997 | Prehn |
| 6,189,964 | B1 | 2/2001 | Henshaw |
| 6,226,582 | B1 | 5/2001 | Adsett |
| D445,553 | S | 7/2001 | Pulskamp |
| D450,169 | S | 11/2001 | Pulskamp |
| 6,382,359 | B1 | 5/2002 | Lohmann |
| 7,146,701 | B2 | 12/2006 | Mahoney |
| 7,151,237 | B2 | 12/2006 | Mahoney |
| 7,314,116 | B2 | 1/2008 | David |
| D562,525 | S | 2/2008 | Graf |
| D563,074 | S | 2/2008 | Standke |
| 7,383,915 | B2 | 6/2008 | David |
| 7,641,020 | B2 | 1/2010 | Lohmann |
| 7,793,979 | B2 | 9/2010 | Kraimer |
| 8,193,903 | B2 | 6/2012 | Kraimer |
| 2009/0200116 | A1 | 8/2009 | Wiggins |

OTHER PUBLICATIONS

The Raymond Corporation, PowerSteer, Apr. 2010.
The Raymond Corporation, Illustrations of P/N 1066671, Jun. 1997.

*Primary Examiner* — Kyung Lee
(74) *Attorney, Agent, or Firm* — Quarles & Brady LLP

(57) ABSTRACT

A control module includes a housing, a continuous cover supported by the housing, and a plurality of switches positioned within the housing in selective mechanical engagement with the continuous cover. Each of the plurality of switches is electrically configured to be capable of independently triggering a particular function when the continuous cover is moved relative to the housing.

20 Claims, 7 Drawing Sheets

85
26
96
22
98
98
98

CONTROL MODULE WITH REDUNDANT SWITCHES

CROSS REFERENCE TO RELATED APPLICATION

Not Applicable

STATEMENT REGARDING FEDERALLY SPONSORED RESEARCH

Not Applicable

BACKGROUND OF THE INVENTION

The present invention relates to control modules, and more particularly to a control module having a continuous cover with redundant switches that are configured to trigger a single, particular function of the control module.

Control modules are often employed to provide an interface allowing a user to manipulate functions that are triggered by the control module. For instance, material handling vehicles, such as those manufactured by The Raymond Corporation of Greene, N.Y., incorporate control modules that can be engaged by an operator to trigger functions including raising and lowering forks, increasing or decreasing truck speed, and sounding the horn. These material handling vehicles are subjected to considerable use in varying environments that can place a high demand on the mechanical and electrical robustness of the overall control module. Increasing application demands continue to challenge the bounds of typical control modules.

In light of at least the above challenges, a need exists for any increasingly robust control module providing enhancements including a continuous cover with redundant switches that trigger a single function of the control module.

SUMMARY OF THE INVENTION

In one aspect, a control module comprises a housing, a continuous cover supported by the housing, and a plurality of switches positioned within the housing in selective mechanical engagement with the continuous cover. Each of the plurality of switches is electrically configured to be capable of independently triggering a particular function when the continuous cover is moved relative to the housing.

In another aspect, a control module comprises a housing, a control board mounted inside of the housing, and a continuous cover supported by the housing. An array of dome switches is positioned within the housing adjacent to the continuous cover and integrated with the control board such that each of the array of dome switches is configured to be capable of independently triggering a particular function when the continuous cover is moved relative to the housing engaging at least one of the array of dome switches.

In yet a further aspect, a method of manufacturing a control module comprises the steps of: providing a housing defining a cavity; positioning an array of contacts within the cavity; connecting the array of contacts such that actuation of each contact in the array of contacts can individually trigger a particular function; and aligning a continuous cover with the array of contacts such that movement of the continuous cover relative to the housing triggers the particular function.

These and still other aspects will be apparent from the description that follows. In the detailed description, preferred example embodiments will be described with reference to the accompanying drawings. These embodiments do not represent the full scope of the concept; rather the concept may be employed in other embodiments. Reference should therefore be made to the claims herein for interpreting the breadth of the invention.

DETAILED DESCRIPTION OF THE PREFERRED EXAMPLE EMBODIMENT

The concepts described below and shown in the accompanying figures are illustrative of an example implementation of the inventive concepts; however, when given the benefit of this disclosure, one skilled in the art will appreciate that the inventive concepts described herein can be modified and incorporated into many other applications. Furthermore, throughout the description terms such as front, back, side, top, bottom, up, down, upper, lower, inner, outer, above, below, and the like are used to describe the relative arrangement and/or operation of various components of the example embodiment; none of these relative terms are to be construed as limiting the construction or alternative arrangements that are within the scope of the claims.

The example control module 10 described herein is configured to allow a user to manipulate and control several features of a device (e.g., a material handling vehicle (not shown)) via the control module 10. Specifically, the control module 10 includes operationally distinct continuous covers (e.g., buttons) that can be actuated (e.g., depressed or moved) by a user to trigger a particular function associated with that button (e.g., the raising or lowering of forks of the material handling vehicle). The configuration and construction of the example control module 10 establishes a functional redundancy by associating multiple switches with each distinct button such that, for instance, actuating a specific continuous cover (e.g., a raise fork button) typically results in multiple switches (e.g., dome switches) beneath the continuous cover being actuated substantially simultaneously or at some phase of the button actuation. Each switch beneath the particular continuous cover is operatively arranged to independently and collectively trigger the identical function, thereby providing a redundant switch configuration for each continuous cover. With the fundamental concepts understood, and in light of the example control module 10 described below, one skilled in the art will appreciate the various application-specific modifications that can be made to implement the concepts into a wide variety of end uses.

Figure 1:
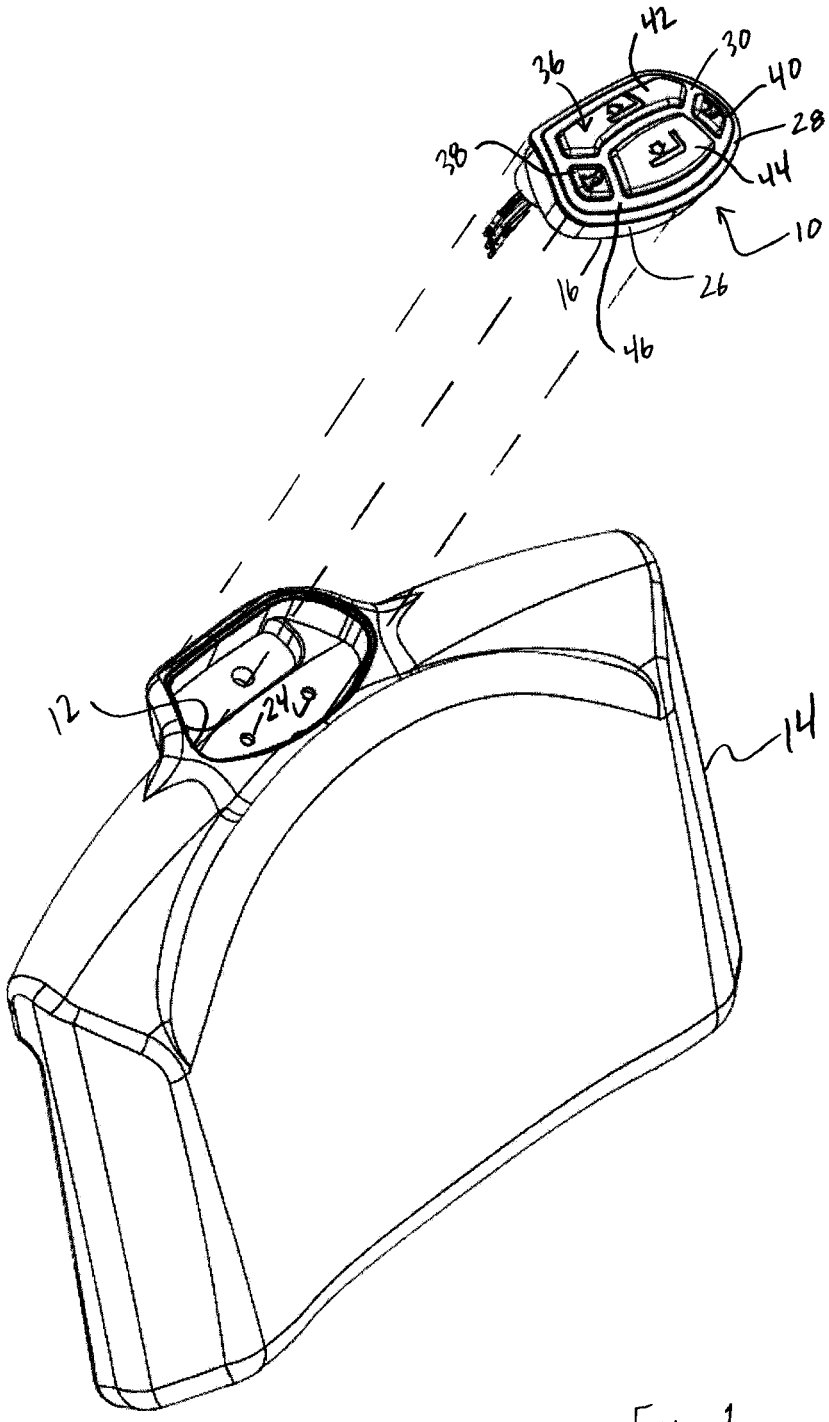
FIG. 1 is an isometric exploded view of an example control module and an example backrest of a material handling vehicle that is configured to receive the example control module.

FIG. 1 illustrates the example control module 10 that is configured to be installed into a pocket 12 formed in an example backrest 14 of a material handling vehicle (not shown). With additional reference to FIG. 2, the control module 10 includes a housing 16 with a pair of threaded inserts 18 secured (e.g., press-fit) into bosses 20 that extend from a back side 22 of the housing 16. Bolts (not shown) protrude through openings 24 in the pocket 12 and are engaged with the threaded inserts 18 to secure the control module 10 to the backrest 14. As one skilled in the art will understand, when given the benefit of this disclosure, both the form factor of the control module 10 and the overall integration of the control module 10 into the ultimate application can vary while concurrently applying the inventive control module concepts.

Figure 2:
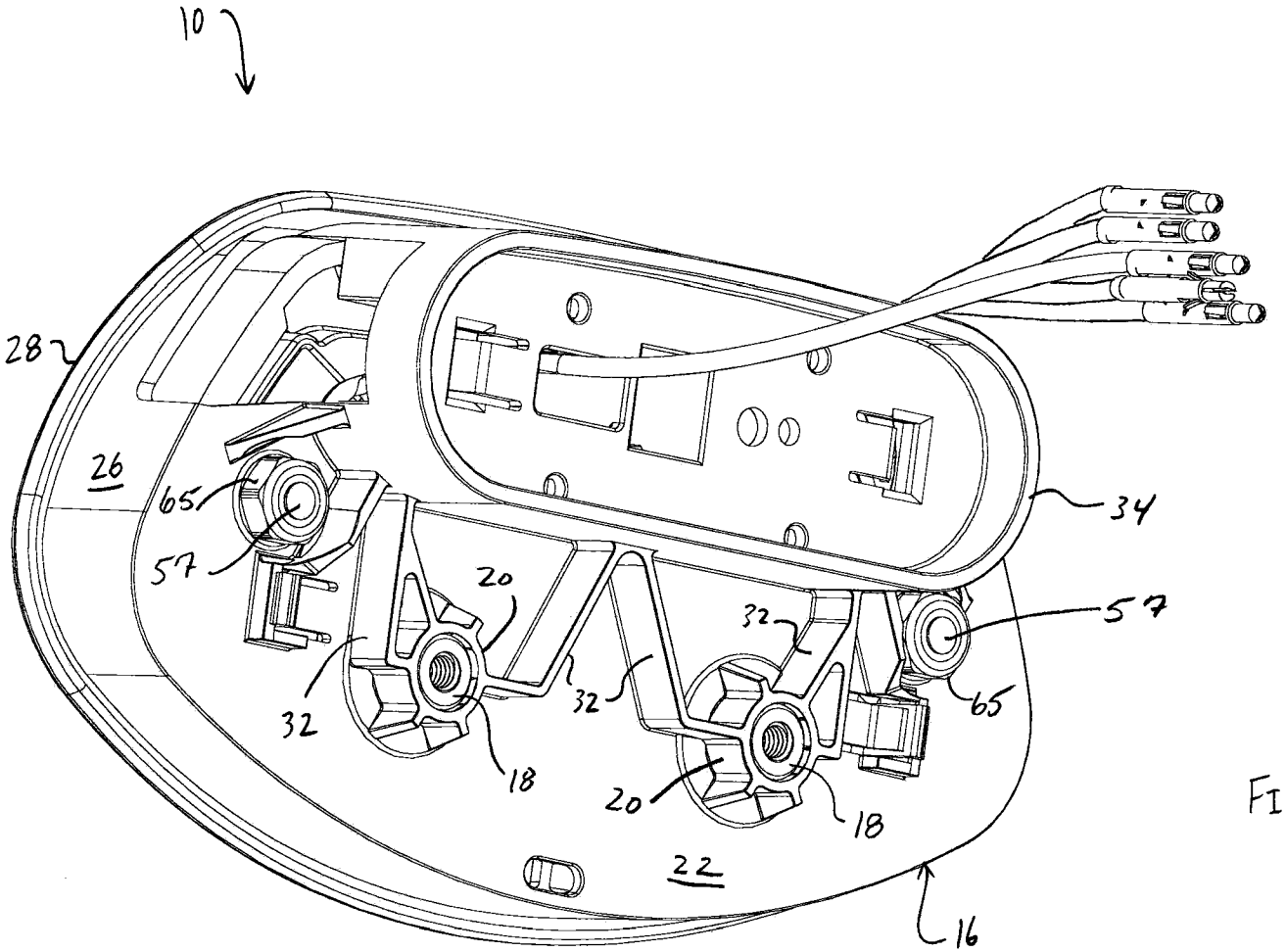
FIG. 2 is a rear isometric view of the example control module.

With continued reference to FIGS. 1 and 2, the example housing 16 of the control module 10 includes a side face 26 that extends between the back side 22 and a lip 28. The lip 28 wraps around to a front side 30 of the housing 16 and generally defines a front perimeter of the housing 16. The back side 22 of the housing 16 also includes a series of support ribs 32 and a stepped portion 34 that is keyed to engage the contours and form factor of the pocket 12 in the example backrest 14 (shown in FIG. 1). Given the particular application requirements, the housing 16 can be manufactured (e.g., molded, machined, assembled, etc.) from a variety of materials including plastics, metals, composites, and the like.

Figure 3:
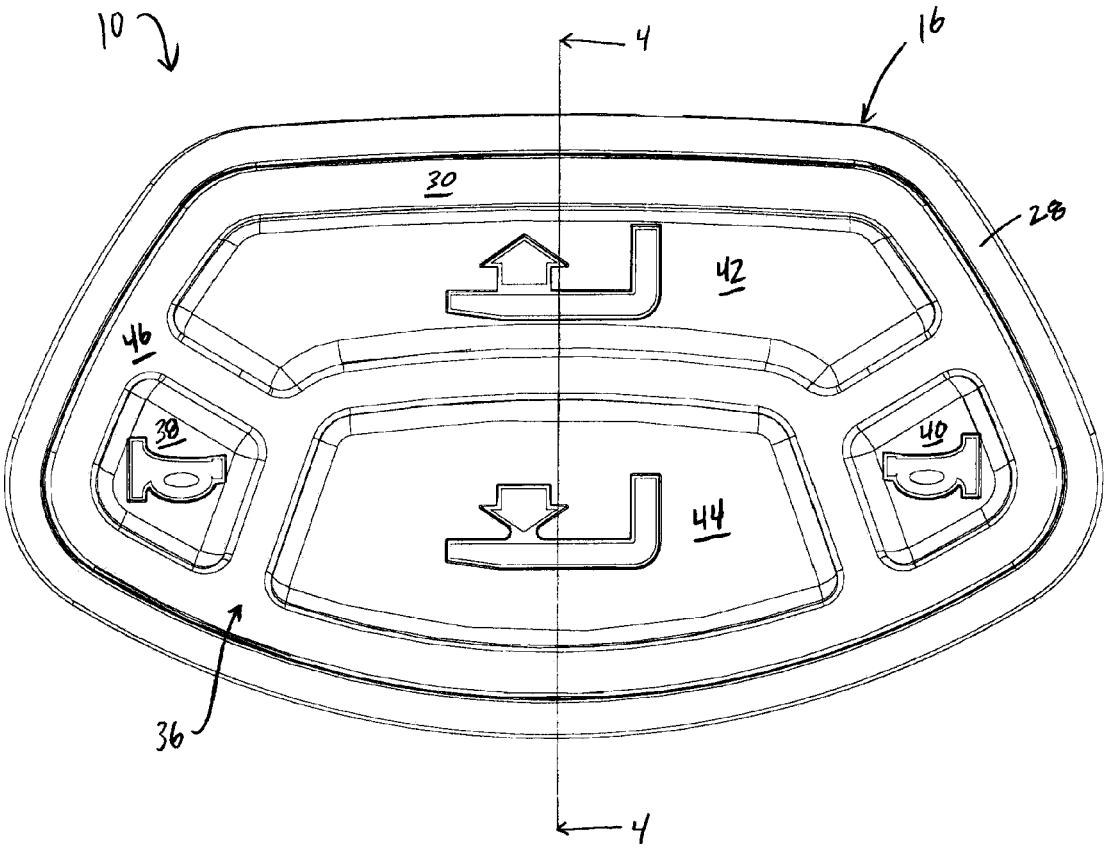
FIG. 3 is a front plan view of the example control module.

Turning to FIG. 3, the control module 10 includes an example membrane 36 that is generally divided into four distinct, but individually continuous cover portions. Each continuous cover defines a button that can be actuated (e.g., depressed) to trigger a particular function that is controlled by the control module 10. In the example embodiment, the membrane 36 includes continuous covers for a left horn button 38, a right horn button 40, a raise fork button 42, and a lower fork button 44.

Figure 4:
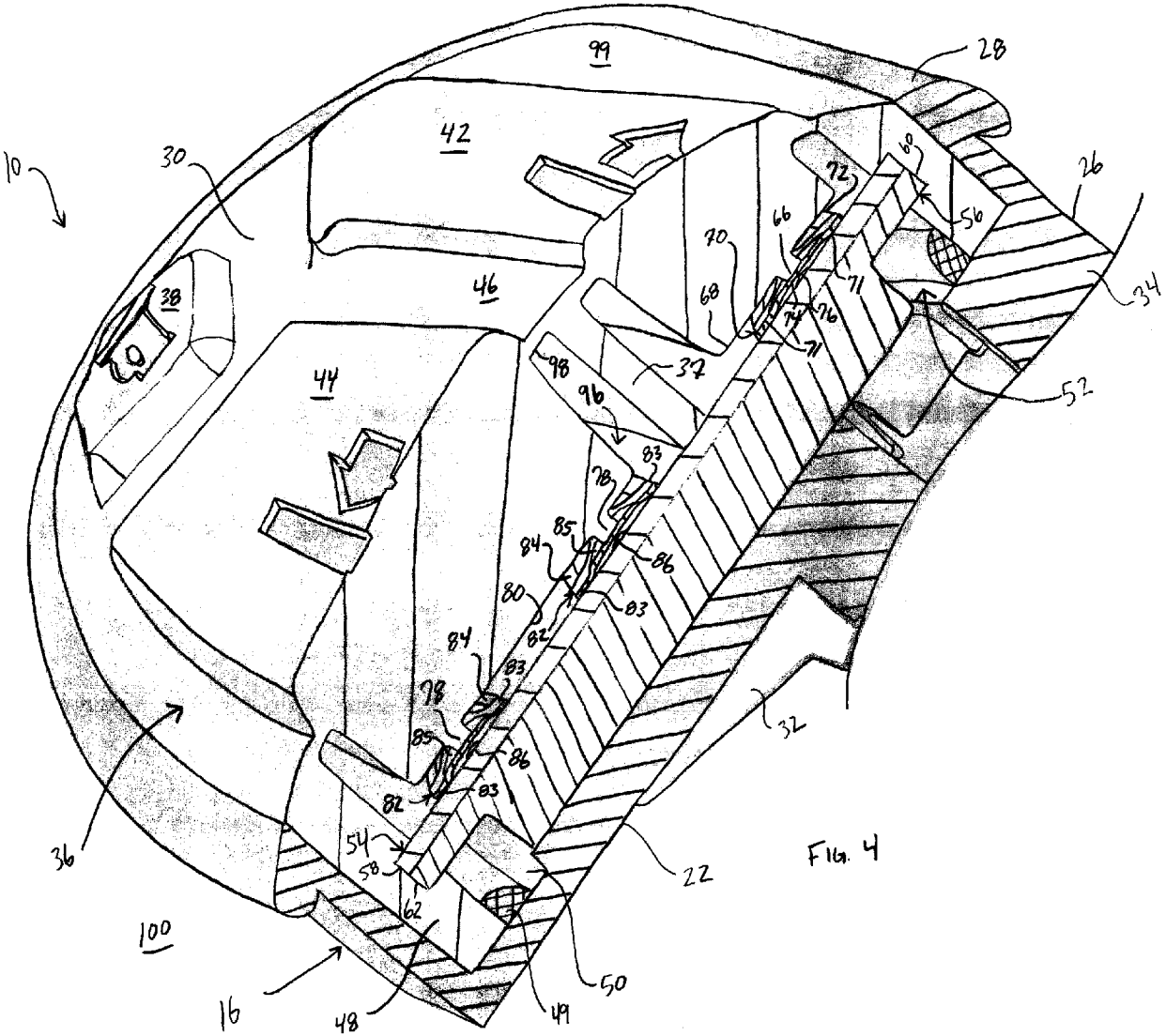
FIG. 4 is a partial section view along line 4-4 shown in FIG. 3.
Figure 5:
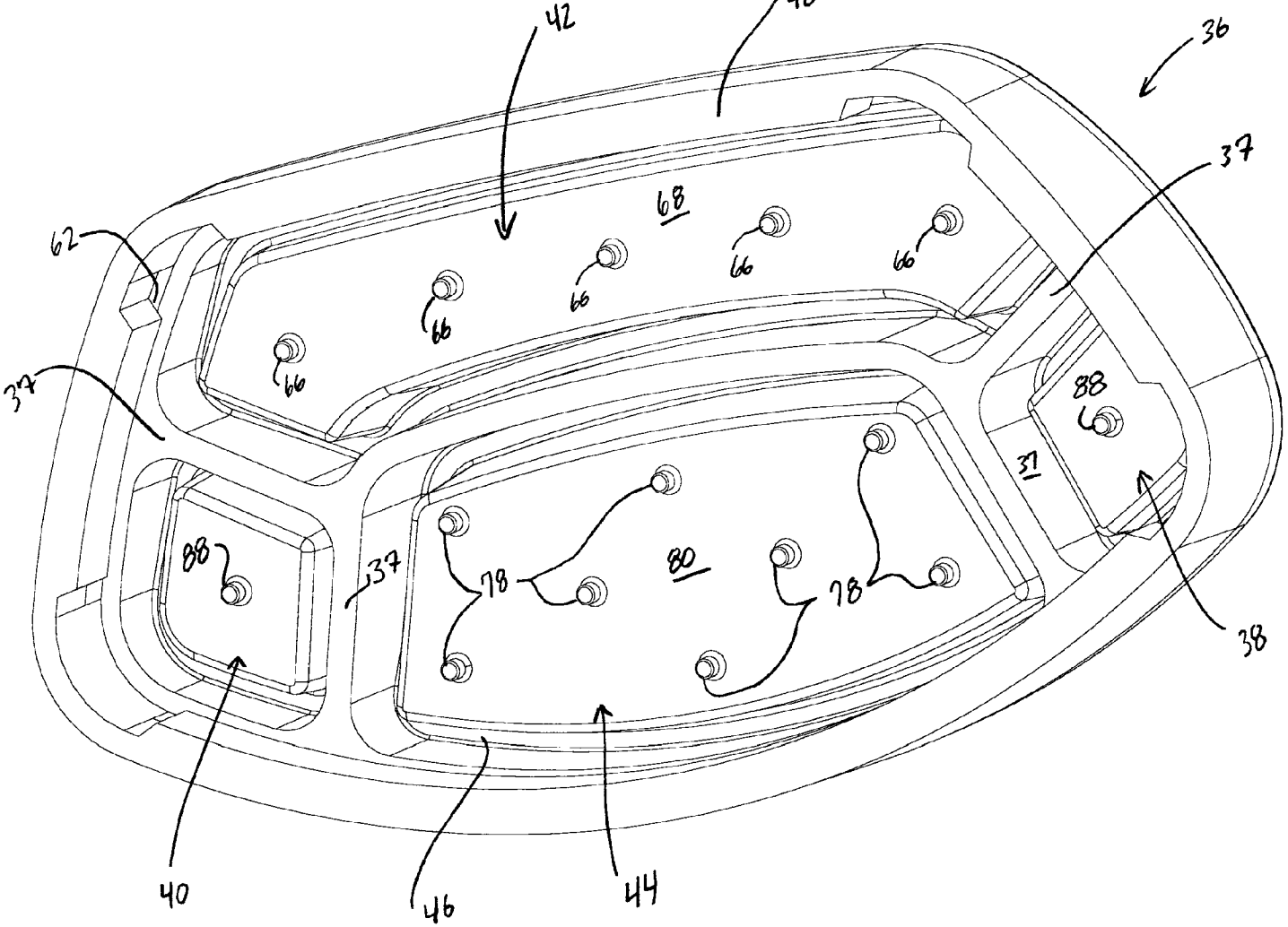
FIG. 5 is a rear isometric view of an example membrane.

With additional reference to FIGS. 4 and 5, each of the buttons is operationally separate and distinct, such that actuating any one button does not result in actuation of any of the other buttons. While each continuous button is generally separately moveable, each of the buttons is illustrated as being integrally molded with a relatively thinner web portion 46 bridging the relatively thicker depth of the raise fork button 42, the lower fork button 44, and the horn buttons 38, 40. The membrane 36 can be made of a silicone rubber material or any other suitable material given the specific application requirements.

The membrane 36 is generally supported by the housing 16 and includes a base 48 about the perimeter of the membrane 36 that is configured to engage with a mounting surface 50 formed in a cavity 52 of the housing 16. As shown in FIGS. 4 and 5, the membrane 36 also includes support ridges 37 that extend from the base 48 and generally follow the outline of the various buttons. Furthermore, a control board 54 (e.g., a printed circuit board) is illustrated as being layered onto a support member 56 and positioned within the cavity 52 of the housing 16. An outer perimeter 58 of the control board 54 and an outer perimeter 60 of the support member 56 are aligned and seated in a slot 62 formed in the base 48 of the membrane 36. The support member 56 also includes a pair of threaded studs 57 (shown in FIG. 2) that extend out the back side 22 of the housing 16 and are engaged by nuts 65 to fix the support member 56 to the housing 16. The control board 54 may comprise a typical printed circuit board made by conventional techniques. The support member 56 is a generally rigid structure that can be incorporated to provide additional structural rigidity to the control board 54 while also providing some shock dampening and electrical insulation. Again, given the specific application requirements for the overall control module 10, the support member 56 can be manufactured from any suitable material.

When the membrane 36 is assembled to the housing 16, a continuous bead 49 of silicone adhesive can be applied adjacent to the base 48 of the membrane 36 that is proximate to the mounting surface 50 of the cavity 52 (shown in FIG. 4). In other forms, a bead of sealant can be applied about a perimeter of the membrane 36 at an interface between the membrane 36 and the housing 16. As a result, the membrane 36 is substantially sealed to the housing 16 thereby inhibiting fluids and other debris from passing between the membrane 36 and the housing 16. In alternative forms, each one of the continuous covers can be completely separate from any other continuous cover and/or individually supported and sealed to the housing 16.

The configuration of the example raise fork button 42/lower fork button 44 with the example control board 54 and switches (described below) is best illustrated with specific reference to FIGS. 4, 5, and 6. The raise fork button 42 is a continuous cover body including five spaced-apart nibs 66 that extend from an interior surface 68 of the raise fork button 42. As best shown in FIG. 4, when the membrane 36 (and thus the raise fork button 42) is positioned to overlay the control board 54, each nib 66 is aligned adjacent to an individual switch (e.g., dome switches 70) that is configured to trigger the particular function of raising the forks. Thus, the control board 54 includes five dome switches 70 that are arranged to mate with the respective nibs 66 of the raise fork button 42. Each dome switch 70 includes legs 71 that are secured (e.g., adhered) to an outer contact ring 72 (best shown in FIGS. 4 and 6) integrated with the control board 54. The dome switch 70 is centered over a central contact 76 that is also integrated with the control board 54. As a result of this arrangement, depressing or moving the raise fork button 42 relative to the housing 16 causes the nibs 66 to engage and deform the respective adjacent dome switch 70. When the raise fork dome switch 70 is deformed, a dome portion 74 makes physical contact with the central contact 76 completing an electrical circuit for each respective dome switch 70. The continuous, semi-rigid construction of the raise fork button 42 preferably results in multiple dome switches 70 being actuated when the raise fork button 42 is moved, regardless of where on the raise fork button 42 a user presses (e.g., at the extreme edges, in the center, etc.). However, the array of dome switches 70 spread over the general area of the control board 54 beneath the raise fork button 42 provides for the likely actuation of at least one of the dome switches 70.

Turning to the lower fork button 44, which is also formed by a continuous cover having a relatively rigid construction (e.g., such that movement of the continuous cover is generally uniform across the continuous cover), eight nibs 78 are laid out in a general array and extend from an interior surface 80 of the lower fork button 44. Similar to the nibs 66 of the raise fork button 42, seven of the eight nibs 78 are operably aligned with a mating switch (in the form of a dome switch 82), with each switch being configured to independently trigger a second function (e.g., lowering the forks). The eighth dome switch position on the control board 54 was removed to accommodate a pressure balance arrangement (described below). The dome switches 82 again include legs 83 that are secured to an outer contact ring 84 formed in the control board 54, and are centered over a central contact 86 formed in the control board 54. When the lower fork button 44 is moved toward the control board 54, at least some of the respective nibs 78 mechanically engage dome portions 85 of respective dome switches 82. Once the actuation force exceeds the defined force limit, the dome portions 85 collapse and make electrical contact with the central contact 86, completing an electrical circuit for each dome switch 82 and triggering (either individually or collectively) the raise fork function of the control module.

Figure 6:
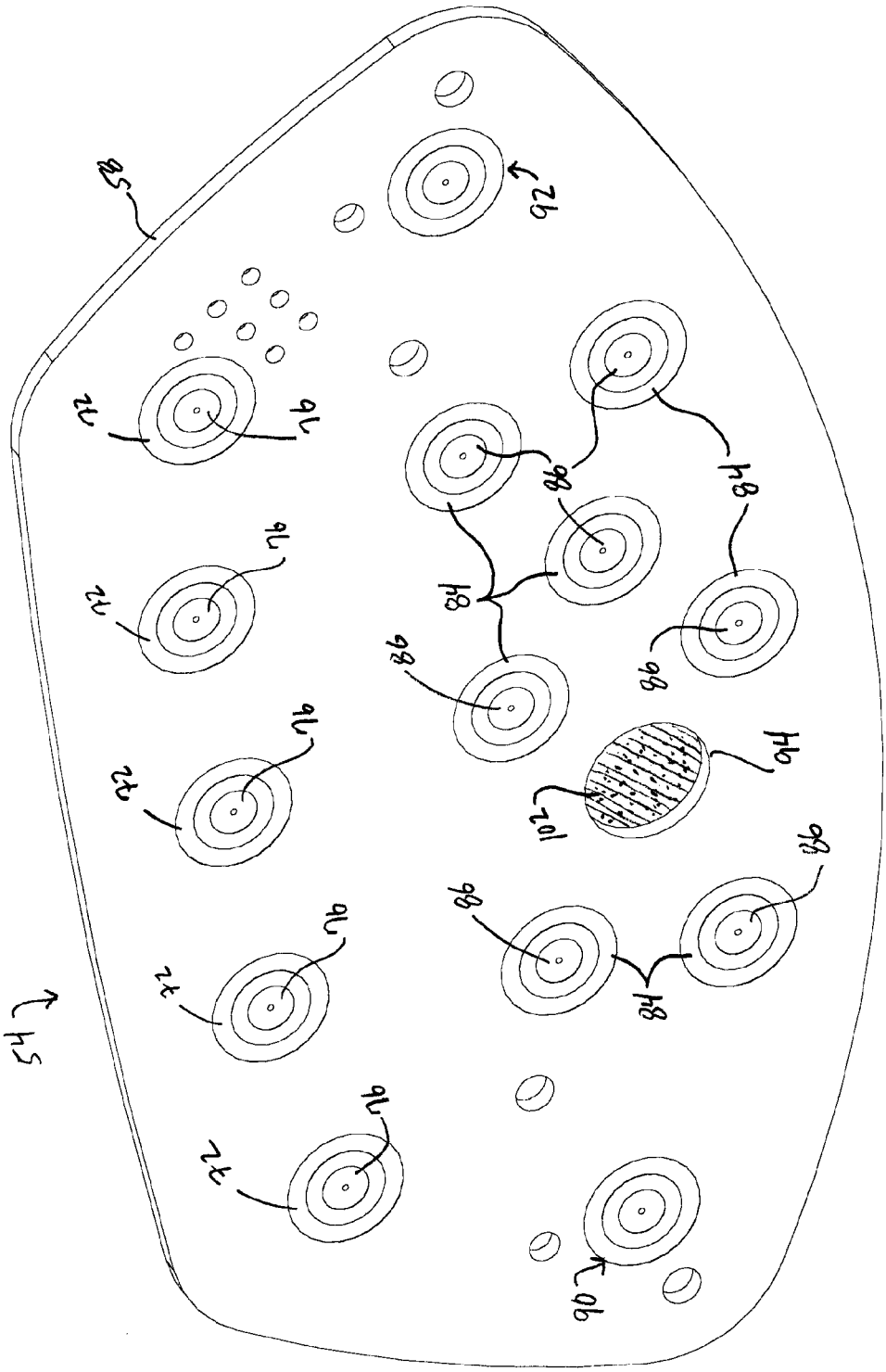
FIG. 6 is a front isometric view of an example control board.

For completeness, the left horn button 38 and the right horn button 40 each include a single nib 88 such that when the membrane 36 is installed to the housing 16, the nibs 88 align with dome switches (not shown) secured to respective left horn contacts 90 and right horn contacts 92 integrated with the control board 54 (shown in FIG. 6). In other embodiments, the horn buttons can be configured to include multiple switches to achieve the redundant array illustrated with respect to the raise fork button 42 and the lower fork button 44.

The example nibs 66, 78 are generally cylindrical and are integrally molded with the membrane 36. However, the nibs may have a variety of form factors, locations, and constructions, such as hemispherical members that are adhered to the back sides of the respective continuous cover. Additionally, the number and placement of the mating nibs and switches for a particular function can be modified to suit particular application requirements. Given the benefit of this disclosure, one skilled in the art will appreciate the variety of configurations that fall within the inventive concept.

In the example configuration, each of the dome switches 70 mounted to the control board 54 is capable of electrically triggering the particular function (e.g., the raise fork function) when the continuous cover (e.g., the raise fork button 42) is moved relative to the housing 16 to mechanically engage and depress the dome switches 70. Similarly, each of the dome switches 82 mounted to the control board 54 is capable of electrically triggering the particular function (e.g., the lower fork function) when the continuous cover (e.g., the lower fork button 44) is moved relative to the housing 16 to mechanically engage and depress the dome switches 82. This arrangement provides for a triggering redundancy for each distinct function. The specific functions being controlled by a control module in accordance with the inventive concepts are application specific and are not limited by the example functions disclosed herein.

Figure 7:
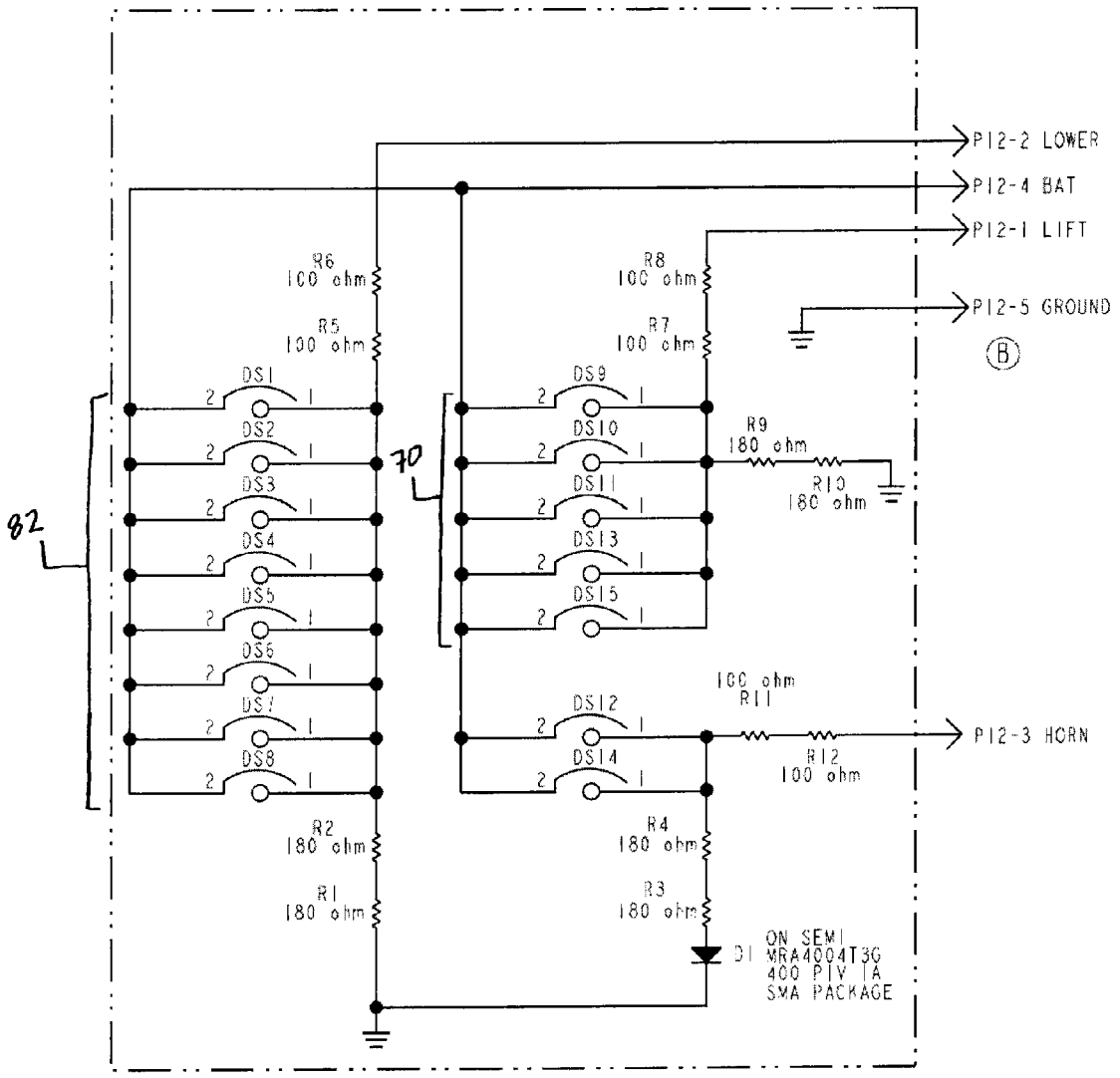
FIG. 7 is an electrical schematic of the example control module.

A simplified electrical schematic of the example control module 10 is illustrated in FIG. 7. As shown, each dome switch 70 for triggering the forks to raise is wired in parallel and shown as DS9, DS10, DS11, DS13, and DS15. Similarly, each dome switch 82 for triggering the forks to lower is wired in parallel and shown as DS1, DS2, DS3, DS4, DSS, DS6, DS7, and DS8. The various dome switches may be similar to the F-Series domes (e.g., part no. F08150) manufactured by Snaptron Inc. of Windsor, Colorado. This multi-switch, redundant array allows for any switch in the respective array to alone or in combination trigger the particular function dictated by the electrical configuration. While dome-type switches are illustrated in the example control module 10, various other types and styles of momentary switches can be used to implement the concept, such as a basic normally open switch (e.g., pull type, rocker type, joystick type, etc.).

Returning to FIGS. 4 and 6, the control board 54 is configured to include a feature that equalizes the pressure on both sides of the membrane 36 when the membrane 36 is sealed to the housing 16. Specifically, the control board 54 includes an opening 94 through the control board 54 between an internal atmosphere 96 generally defined between the control board 54 and the back side 98 of the membrane 36 and an external atmosphere 100 generally defined between the control board 54 and the surrounding environment (which includes a front side 99 of the membrane 36 thus establishing a pressure differential across the membrane 36). A vent membrane 102 is secured (e.g., adhered) to the control board 54 and covers the opening 94. However, the vent membrane 102 is configured to allow the passage of air while inhibiting the passage of debris such as fluids and dust. One example vent membrane 102 comprises a GORE® Pressure Vent made by W.L. Gore & Associates, Inc. of Elkton, Md. The vent membrane 102 permits pressure equalization between the internal atmosphere 96 and the external atmosphere 100.

While there has been shown and described what is at present considered the preferred embodiments, it will be appreciated by those skilled in the art that various changes and modifications can be made without departing from the scope of the invention defined by the following claims (e.g., the relative proportions and dimension of the components can be altered, and, where applicable, various components can be integrally formed or single components can be separated into multiple pieces).

We claim:

1. A control module comprising:

a housing;

a continuous cover supported by the housing; and a plurality of switches positioned within the housing in selective mechanical engagement with the continuous cover, wherein each of the plurality of switches is electrically configured to be capable of independently triggering a particular function and multiple switches of the plurality of switches are operatively arranged to be capable of independently triggering an identical function when the continuous cover is moved relative to the housing.

2. The control module of claim 1 further comprising:

a second continuous cover supported by the housing; and a second plurality of switches positioned within the housing in selective mechanical engagement with the second continuous cover, wherein each of the second plurality of switches is electrically configured to be capable of independently triggering a second particular function when the second continuous cover is moved relative to the housing.

3. The control module of claim 1 wherein the plurality of switches comprises multiple momentary, normally-open switches.

4. The control module of claim 1 further comprising:

a control board mounted inside of the housing; and wherein the plurality of switches comprises an array of dome switches mounted to the control board such that each dome switch in the array of dome switches is capable of electrically triggering the particular function when the continuous cover is moved relative to the housing.

5. The control module of claim 4 wherein the array of dome switches is electrically coupled in parallel.

6. The control module of claim 4 further comprising:

a second continuous cover supported by the housing; and a second array of dome switches mounted to the control board such that each dome switch in the second array of dome switches is capable of electrically triggering a second particular function when the second continuous cover is moved relative to the housing.

7. The control module of claim 1 wherein the continuous cover comprises a membrane positioned to overlay the plurality of switches and is sealed to the housing to form a seal about a perimeter of the membrane.

8. The control module of claim 1 wherein:

the continuous cover includes a plurality of nibs extending from an interior surface of the continuous cover; and each of the plurality of nibs is positioned adjacent to a mating one of the plurality of switches to engage the mating one of the plurality of switches when the continuous cover is moved relative to the housing.

9. The control module of claim 1 further comprising:

a control board mounted inside of the housing and separating an internal atmosphere on a first side of the control board and an external atmosphere on a second side of the control board, the control board defining an opening through the control board between the internal atmosphere and the external atmosphere; and a vent membrane secured to the control board to cover the opening through the control board such that the vent membrane permits pressure equalization between the internal atmosphere and the external atmosphere.

10. The control module of claim 1 wherein the particular function is raising forks of a material handling vehicle under control of the control module.

11. A control module comprising:

a housing;

a control board mounted inside of the housing;

a continuous cover supported by the housing; and an array of dome switches positioned within the housing adjacent to the continuous cover and integrated with the control board such that each of the array of dome switches is configured to be capable of independently triggering a particular function and such that multiple dome switches of the array of dome switches are configured to be capable of independently triggering an identical function when the continuous cover is moved relative to the housing engaging at least one of the array of dome switches.

12. The control module of claim 11 further comprising:

a second continuous cover supported by the housing; and a second array of dome switches positioned within the housing adjacent to the second continuous cover and integrated with the control board in parallel electrical communication such that each of the second array of dome switches is electrically configured to be capable of independently triggering a second particular function when the second continuous cover is moved relative to the housing.

13. The control module of claim 12 wherein:

the continuous cover and the second continuous cover are integrated into a membrane positioned to overlay the array of dome switches and the second array of dome switches; and the membrane is sealed to the housing about a perimeter of the membrane.

14. The control module of claim 11 further wherein:

the continuous cover includes an array of nibs extending from an interior surface of the continuous cover; and the array of nibs is arranged to individually align with each dome switch of the array of dome switches such that movement of the continuous cover relative to the housing engages at least one of the array of nibs with at least one of the array of dome switches to trigger the particular function.

15. A method of manufacturing a control module comprising the steps of:

providing a housing defining a cavity;

positioning an array of contacts within the cavity;

connecting the array of contacts such that actuation of each contact in the array of contacts can individually trigger an identical particular function; and aligning a continuous cover with the array of contacts such that movement of the continuous cover relative to the housing triggers the particular function.

16. The method of manufacturing a control module of claim 15 further comprising the steps of:

positioning a second array of contacts within the cavity;

electrically connecting the second array of contacts in parallel to selectively trigger a second particular function;

aligning a second continuous cover with the second array of contacts such that movement of the second continuous cover relative to the housing triggers the second particular function.

17. The method of manufacturing a control module of claim 15 further comprising the step of sealing a perimeter portion of the continuous cover to the housing to substantially enclose the array of contacts within the housing.

18. The method of manufacturing a control module of claim 17 wherein sealing the perimeter portion of the continuous cover to the housing to substantially enclose the array of contacts within the housing comprises applying a continuous bead of sealant between the perimeter portion and the cavity of the housing.

19. The method of manufacturing a control module of claim 15 further comprising the step of mounting a control board into the cavity of the housing.

20. The method of manufacturing a control module of claim 19 wherein positioning the array of contacts within the cavity comprises operatively integrating an array of dome switches to the control board.

* * * * *